US009921509B2

(12) United States Patent
Cooper et al.

(10) Patent No.: US 9,921,509 B2
(45) Date of Patent: Mar. 20, 2018

(54) PROCESS FOR PREPARING NOVEL COMPOSITE CHARGE CONTROL AGENTS AND NOVEL COMPOSITE CHARGE CONTROL AGENTS PREPARED BY THE PROCESS

(71) Applicant: Esprix Technologies, LP., Sarasota, FL (US)

(72) Inventors: John Francis Cooper, Hendersonville, NC (US); Tonya Nicole Pless, Sarasota, FL (US); Mark William Cummings, Lakewood Ranch, FL (US); Jana Petrova, Ellenton, FL (US); Jeff Lee Morgan, Sarasota, FL (US)

(73) Assignee: Esprix Technologies, LP, Sarasota, FL (US)

( * ) Notice: Subject to any disclaimer, the term of this patent is extended or adjusted under 35 U.S.C. 154(b) by 142 days.

(21) Appl. No.: 14/944,859

(22) Filed: Nov. 18, 2015

(65) Prior Publication Data

US 2016/0139525 A1 May 19, 2016

Related U.S. Application Data

(60) Provisional application No. 62/123,484, filed on Nov. 18, 2014.

(51) Int. Cl.
*G03G 9/097* (2006.01)
*G03G 9/08* (2006.01)

(52) U.S. Cl.
CPC ..... *G03G 9/09716* (2013.01); *G03G 9/0804* (2013.01)

(58) Field of Classification Search
CPC ..... G03G 9/09716; G03G 9/0804
USPC ..... 428/403
See application file for complete search history.

(56) References Cited

U.S. PATENT DOCUMENTS

| | | | | |
|---|---|---|---|---|
| 3,720,617 | A | 3/1973 | Chatterji et al. | |
| 3,893,935 | A | 7/1975 | Jadwin et al. | |
| 3,971,749 | A | 7/1976 | Blunt | |
| 4,298,472 | A | 11/1981 | Durand et al. | |
| 4,344,858 | A | 8/1982 | Zucker et al. | |
| 4,362,803 | A | 12/1982 | Miyakawa et al. | |
| 4,433,040 | A | 2/1984 | Niimura et al. | |
| 4,717,561 | A | 1/1988 | Krivak et al. | |
| 4,828,954 | A | 5/1989 | Hashimoto et al. | |
| 4,965,158 | A | 10/1990 | Gruber et al. | |
| 5,321,070 | A | 6/1994 | Meier et al. | |
| 5,356,667 | A | 10/1994 | Hench et al. | |
| 5,401,313 | A | 3/1995 | Supplee et al. | |
| 5,439,770 | A | 8/1995 | Taya et al. | |
| 5,555,813 | A | 9/1996 | Hale et al. | |
| 5,674,655 | A * | 10/1997 | Guistina | G03G 9/08708 430/106.2 |
| 5,763,130 | A * | 6/1998 | Sasaki | G03G 9/09328 430/109.5 |
| 5,900,315 | A | 5/1999 | Little | |
| 6,090,515 | A | 7/2000 | Tomiyama et al. | |
| 6,120,958 | A | 9/2000 | Ookubo et al. | |
| 8,580,470 | B2 | 11/2013 | Otsuka et al. | |
| 9,085,668 | B2 | 7/2015 | Sakai et al. | |
| 2006/0269862 | A1 * | 11/2006 | Kobayashi | G03G 9/0833 430/111.31 |

* cited by examiner

*Primary Examiner* — Leszek Kiliman
(74) *Attorney, Agent, or Firm* — Dinsmore & Shohl LLP

(57) ABSTRACT

A composite charge control agent for use in electrostatic imaging comprises porous, inorganic core particles of at least 0.08 microns in diameter, impregnated with 2% to 50% by weight of one or more charge control chemicals and up to 50% by weight of one or more additional compounds such as a polymer, a wax, a dye, or other organic chemicals.

14 Claims, No Drawings

PROCESS FOR PREPARING NOVEL COMPOSITE CHARGE CONTROL AGENTS AND NOVEL COMPOSITE CHARGE CONTROL AGENTS PREPARED BY THE PROCESS

CROSS-REFERENCE TO RELATED APPLICATIONS

This application claims priority of U.S. Provisional Patent Application Ser. No. 62/123,484, filed Nov. 19, 2014, which is incorporated herein by reference.

FIELD OF THE INVENTION

The instant invention relates to a versatile process for preparing composite powders that can be used as novel electrostatic charge control agents. The inventive process involves impregnating specific sized inorganic core particles with at least one known charge control chemical and optionally one or more additional components selected from dyes, pigments, colorants, polymers or organic chemicals.

BACKGROUND OF THE INVENTION

A variety of imaging applications require powders with specific particle size distributions and electrostatic charge; and frequently, complex compositions. A few examples include dry or liquid electrophotographic toners, electrostatic charge control agents used for dry or liquid toners or powder coatings, and fluorescent or phosphorescent marking particles used for security or identification purposes. Current processes used to produce these particles are typically complex, expensive, and may not be versatile enough to produce a wide variety of such powders.

The use of dry toners to print electrostatic or magnetographic images has been practiced for over 50 years. Such toners have evolved from relatively simple compositions of polymer and carbon black pigment to today's toners which typically comprise one or more polymers, pigments, waxes, charge control agents and a wide variety of particulate additives. Imaging of such toners is most commonly accomplished by an electrophotographic process that involves charging of a photoreceptor, selective discharge of the photoreceptor via light lens, laser or LED, imagewise deposition of toner particles onto the photoreceptor, transfer of the toner particles to paper or other substrate and fusing of the deposited toner. Typically the photoreceptor is cleaned for reuse.

Current electrophotographic printing systems are placing increasing demands on toners, both in terms of image quality and also machine reliability. The toners must provide sharp, dense, low background, and well-fixed images. Color images must have appropriate hue, saturation and a certain level of gloss. The toners must be compatible with printer sub systems to contribute to photoreceptor cleaning and fuser release. To achieve these goals toners are designed with smaller and narrow particle size distributions, stable charge distributions, and specific melt rheology. These toner properties are obtained by specific compositions of polymers, pigments, colorants, charge control agents, waxes and miscellaneous additives.

Meeting the requirements of current toner-based hardware has become a challenge for toner designers. In particular, there are issues related to using significant quantities of wax in toners, uniform toner charging, ability to use novel polymers, and control of particular shape and size. Each of these issues is addressed by the current invention. In addition, the current invention allows for the production of unique toners and additives that can be incorporated into toners and powders to improve their performance.

A first aspect of the present invention provides a versatile process for preparing lower cost toner charge control agents, and particularly ones that offer benefits over current commercial materials.

Electrostatic charging of toner (usually referred to as "triboelectric" charge after the Greek word "tribo" meaning "to rub") occurs when toner contacts a second component carrier or other charging surface. This toner charging is a surface phenomenon dependent on the physics and chemistry of both the toner and charging surface. In single component developers this charging surface can be a metering blade or charge roll, often coated with polymers or specialty chemicals that can influence toner charge. In dual component systems a carrier serves a dual function of charging and transporting toner. The carrier surface is typically coated with polymers that provide both durability and at least some degree of toner charging.

While toner charging can be influenced by the secondary charging surface, it is usually the toner composition itself that has the greatest influence on most charge properties. Toner polymers, for example, have a certain intrinsic charge that could be positive or negative, depending on their composition. Usually those binders are various styrene acrylic or polyester compositions and the vast majority have a tendency to charge negative. Inclusion of carbon black in a toner can raise this negative charge magnitude, particularly if the carbon has an acidic functionality. However, addition of carbon black will not usually provide fast charge rate, particularly when admixing new toner with existing toner. Likewise carbon black alone will not change the charge polarity. In addition, carbon black is not suitable for color toners. Another technique to influence toner charging is to attach particulate additives to the toner surface.

While the materials and techniques described above can serve to modify toner charge, they are often not sufficient to provide the complete range of charge polarity, charge magnitude, charge rate and charge stability. A solution has been to include a specialty chemical charge control agent within the toner composition. The amount of charge control agent traditionally used in these formulations may range from 0.5 to 4% or more, depending on the charge rate, charge magnitude and charge distribution desired.

The mechanism by which internal toner charge control agents work is not always well understood, and may differ depending on the charge agent composition and specific carrier or charging surface. Many of those skilled in the art have postulated electron exchange mechanisms based on "work function" differences between toner and carrier. Based on this mechanism, electron accepting functionality such as COOH, $CONR_2$, $SO_3^-$, $SO_2NR_2$ will predominantly tend to increase negative charging of the toner. Other researchers have postulated that ion exchange is the dominant mechanism of charge control function. Thus, substances that can release $OH^-$ or attract $H^+$ would tend to charge positive. Proton donors or $OH^-$ acceptors would increase negative charging.

Investigations of certain ionomers in the prior art suggest the theory that mobile anions can transfer to carrier surfaces and that higher charge is obtained where one species is mobile as opposed to when both anion and cation are mobile. This theory helps explain the differing charge behavior of similar azo dyes. Many chromium based azo dyes have been claimed as negative charge control agents.

However, the most effective metal complex azo dye structures have small, mobile cations such as hydrogen, sodium or ammonium. Functional groups such as nitro that help to delocalize the charge within the larger anion also appear to improve azo dye charge control function.

To be suitable as a toner charge control agent, a chemical material must meet a great many criteria. This has proven to be a difficult goal to meet as many materials will have one or more positive attributes but fail in critical areas. In general, an ideal charge control agent would possess the following characteristics. Correct charge polarity is the most obvious attribute. High charge magnitude is usually desirable as it will allow moderate concentrations of CCA to be used. High concentrations are undesirable both because of excessive expense, but also because the CCA may adversely affect toner rheology as well as its mechanical and electrical properties. Excessively high charge magnitude can also be disadvantageous as low concentrations of CCA would be required and this can be difficult to uniformly disperse. Ideally the charge magnitude will have a relatively small concentration dependence to facilitate uniform toner production. The electrostatic charge should remain stable over time, amount of mixing, and changing environmental conditions. The charge agent should provide good toner "admix", where fresh toner can be combined with existing toner and rapidly achieve the same charge. A charge agent must be thermally stable to toner processing conditions. A charge agent should be readily and uniformly dispersed within the binder resin. Poor dispersion can contribute to free charge agent particles that can contaminate photoreceptors, charge rolls, developer rolls or carrier surfaces. Additional desirable characteristics include low electrical conductivity, no interaction with machine components and non-migrating or blooming. Color toners will obviously require colorless (or the same color as the toner) charge control agents. Finally, charge agents should be of reasonable cost and be free from environmental or hazardous characteristics.

A great number of chemical materials have been patented and/or sold as a charge control agents. Among the most popular positive charge agents has been the family of aniline dyes better known as nigrosines, typified by Solvent Black 7. Nigrosine base may also be reacted with hydrochloric acid to produce an alcohol soluble variety. A sulfonate salt is Acid Black 2. Frequently the nigrosine base is reacted with stearic or oleic acid to improve polymer dispersibility. Nigrosines were among the first positive charge agents and still find extensive use today. They offer high charge, low cost and some tinting value. Disadvantages include toxicological concerns, difficulty in achieving narrow charge distributions and their dark color, which presents a problem for color toners. Other basic dyes such as triarylamines exhibit high positive charge and are more environmentally friendly, although they are also dark colored and not suitable for color toners. Colorless quaternary ammonium salts such as tetrapentyl ammonium chloride were first patented by Eastman Kodak (U.S. Pat. No. 3,893,935) during the early 70s as positive charge agents. Since that time an extensive array of colorless quaternary ammonium and phosphonium salts have been patented and used commercially. They offer advantages for color toners, are environmentally friendly, and can be relatively inexpensive. Quaternary salts are not without their disadvantages though. Electrostatic charge magnitude is not necessarily very high, heat stability can be an issue, charge rate is not always fast, and they can be more sensitive to humidity. Polymeric quaternary ammonium salts are another option for positive charge toners, but again, their charge magnitude may not be as high as desired.

It was mentioned earlier that most typical polymer/pigment combinations inherently charge negative. Thus it would not be immediately obvious that charge control agents would also be desired for negative charge toners. However, the demands of modern EP systems require fast, uniform, and stable charging. It was discovered in the mid 1970s that certain chromium complex azo dyes could contribute to rapid, stable and high magnitude electrostatic charging. The most effective of these early dyes were nitro-substituted versions with hydrogen or ammonium cations such as Acid Black 63. These dyes were highly colored and had other disadvantages, particularly the fact that they often showed a positive Ames test indicating that they may be a possible mutagen. Improved chromium complex dyes such as Hodogaya's Spilon Black TRH were later introduced (U.S. Pat. No. 4,433,040 to Niimura) and have been among the most popular current negative charge agents used by the toner industry. These dye structures have delocalized electrons and mobile cations such as hydrogen, ammonium, and sodium that contribute to higher negative charging. Although the charge characteristics of this azo dye are very effective, it is not without disadvantages that include high cost, its dark color and the fact that chromium is present. Certain iron complex azo dyes have also been found to function as toner charge control agents and these would be considered more environmentally friendly. One example is T-77, sold by Hodogaya Chemical. While this material does not contain chromium and thus is more environmentally friendly, its charge control properties are not as effective as certain chromium based charge control dyes, particularly when used with iron oxide-containing single component toners. It is not clear if this difference in performance is related to dye chemistry, degree of dispersion, or some other interaction with toner components. In U.S. Pat. No. 5,439,770 Taya teaches that using an acid functional polymer binder with an iron complex charge agent will provide improved charge properties. In U.S. Pat. No. 6,090,515 Tomiyama teaches that inclusion of a long chain alkyl compound with iron based charge agents will provide improved toners. The long chain alkyl compound has terminal —OH or —COOH groups and from 35 to 150 (—CH2-) groups. In U.S. Pat. No. 6,120,958 Ookubo teaches that a particle size of 6-15 microns is preferred for an iron based charge control agent. While these techniques can sometimes be used to improve the performance of an iron based azo dye charge agent in specific toner formulations, they are not universally acceptable in providing all of the desired toner charge characteristics with other formulations. In addition, excessive quantities of charge agent may be required and this leads to high toner cost.

For many color toners a colorless or lightly colored charge agent is required. One group of commercial colorless charge control agents comprise zinc, aluminum, or zirconium metal complexes offered by Orient Chemical or Hodogaya Chemical. Colorless polymeric charge control agents are also available from Fujikura Kasei. Environmentally friendly non-metal complexes are also available from Clariant. While these colorless or lightly colored compounds may improve the charge performance of many toner formulations, the charge rate and charge magnitude are frequently inferior to that which can be obtained by the highly colored chromium based azo dyes, and thus higher quantities may be required. These colorless compounds can also be significantly more expensive than most colored charge agents.

One option for overcoming some of the challenges of using internal charge control agents has been to use ultrafine particles on the surface of a toner as disclosed by Chatterji in U.S. Pat. No. 3,720,617. A wide variety of metal oxides, fine polymer particles, metal stearates and miscellaneous powders are commonly added to toner surfaces. These powders are usually added to improve powder flow as well as assist in photoreceptor cleaning, but they can also be used to modify toner charge. Among the most common of these additives are the silicon, aluminum and titanium metal oxides. These particles typically have an ultimate particle size of from 10 to 50 nm, with some new varieties being as large as 200 nm, however as size becomes larger it is more difficult for the particles to adhere to toner surfaces. The metal oxide particles are usually treated with silicone oil and/or silanes and titanates to control their charge and hydrophobicity.

It is possible to treat these ultrafine particles with other compounds to influence their electrostatic charge. For example, Hashimoto in U.S. Pat. No. 4,828,954 discloses treating the surface of fine particle size silica with an onium salt. Gruber in U.S. Pat. No. 4,965,158 discloses improved toners where charge enhancing additives are sorbed on the surface of flow additives. Miyakawa in U.S. Pat. No. 4,576,888 discloses a dye bonded to silica using an aminosilane coupling agent. Another patent describing ultrafine silica treated with a material to alter its charge is U.S. Pat. No. 5,178,984 where Nagatsuka treats ultrafine silica with a copolymer. Little in U.S. Pat. No. 5,900,315 produces charge-modified metal oxides by treating fine metal oxides with cyclic silazanes In each of these patents, the silica is of a particle size significantly less than 100 nm and is intended for use as a toner surface additive, rather than be included in a toner composition as traditional charge agents are used. While externally added, treated, fine size metal oxides may improve the charging behavior of some toners, they do not satisfy all the charging requirements. Externally applied, treated metal oxides can be sensitive to high humidity with a resultant diminished print quality. The externally applied particles can also separate from toners during use and contaminate machine components as well as alter the toner charge. These ultrafine particles are also not suitable as internal charge agents because their small particle size tends to dissociate charge rather than create localized charge centers. U.S. Pat. No. 5,674,655 to Guistina discloses toner compositions where an ultrafine metal oxide is blended in a toner. However, the intended application is for odor control.

Despite the availability of numerous commercial charge control agents there continues to be a need for improved materials for both traditionally prepared extruded toners as well as new directly polymerized versions. As mentioned earlier, many typical charge agents are dyes, pigments or organic chemicals and are available as relatively large agglomerates. Toner preparation processes may break up these agglomerates to some degree but excellent dispersion is often difficult to achieve. Non-uniform dispersion results in excess charge agent in some particles and an insufficient amount in others, resulting in toners that provide non-uniform image quality and a reduced efficiency. In addition, the charge control agent can be the most expensive component of a toner and it would be desirable to be able to maintain its functional quality while reducing the quantity used. Another desired improvement would be a technique for manipulating the charge magnitude of specific charge agents without changing the total quantity of charge agent used. In this way a set of color toners could achieve similar charge characteristics using the same material. It would also be desirable for a charge agent to function both in conventional as well as direct polymerization processes. Another significant benefit of the inventive process is a technique of providing charge agents with properties tailored for a wide variety of applications, without the need of developing new chemical entities that would require separate chemical registration.

While the concept of improved charge agent particles by themselves is a suitable goal, it would be even more beneficial if additional components could be included in the charge agent composition such as wax or even specialty chemicals for security identification. In particular, the ability to include a quantity of wax in the charge agent composition would have significant benefits. From a historical perspective, the first copiers used non-contact radiant or oven fusing to soften low melt viscosity toners. A disadvantage of those systems was inadequate paper adhesion, raised images, and occasionally, paper fires. Most modern electrophotographic engines use heat/pressure rolls to soften and force the toner into paper fibers. Optimum fusing occurs when all toner adheres to the paper. A problem can occur if the complete toner layer softens but the layer splits, resulting in some "toner offset" to the hot roll fuser. To a limited extent this can be cleaned by wipers or blades. More typically hot offset toner transfer to undesired front or rear paper surfaces. One option to reduce hot offset has been to equip fuser rolls with a silicone oil lubrication system. Such systems can be messy and complex and are today commonly used only in some color and high speed printers. A novel solution to this issue was the use of fuser rolls with silicone or fluorocarbon release surfaces in combination with high cohesive strength polymers. Additionally, sharp melting point waxes are included in the toner and when melted act as an internal lubricant. Although this solution is usually quite adequate for producing a wide variety of black toners it presents challenges for color toners. Color toners are typically prepared using low melt viscosity polymer binders and these provide poor release of the toner from non-lubricated fuser rolls. Many full color systems have resorted to use of high concentrations of internal wax lubricants or release agents in a toner. However these lubricants are not usually compatible with toner polymers and they reduce shear in melt extrusion, thus making toner preparation difficult. An additional problem of toners containing melt mixed wax lubricants is that the incompatible wax may separate from the toner during milling operations. The wax particles form satellites that can adhere to toner surfaces. During the electrophotographic process these wax particles may separate from the toner and adhere to such machine components as charge rolls or photoreceptors, with resulting degradation of print image quality. Polymer/wax compatibilizers are sometimes included in a toner composition to minimize this problem but this does not provide a completely satisfactory solution.

The present invention includes a process of impregnating inorganic cores as a means of preparing novel and improved electrostatic charge control agents. This general concept of using inorganic particles as carriers for other materials is not novel in itself, and the use of relatively large size precipitated silica or inorganic particles as carriers of various liquid or polymeric compounds is well known. For example the H.M. Huber web site mentions that various inert powders such as silica, calcium silicate and calcium carbonate can function as excipients for fast-dissolving oral dosage tablets. Zucker in U.S. Pat. No. 4,344,858 discloses treated silica particles to serve as anti-foaming agents. Krivak in U.S. Pat. No. 4,717,561 discloses 0.14 to 0.84 mm silica as a carrier of vitamins. Meier in U.S. Pat. No. 5,321,070 discloses silica treated with resorcinol compounds as rubber adhesion promoters. Durand in U.S. Pat. No. 4,298,472 impregnates anhydrous silica with polar organic compounds to modify its adsorbent properties. Hench in U.S. Pat. No. 5,356,667 utilizes a porous silica to adsorb a laser dye. Xu in U.S. Pat. No. 5,555,813 uses molecular sieves to function as a carrier of a dye. Hi-Sil 223 silica, commercially available from PPG Industries, is used to absorb hexamethoxymethyl melamine resin as an adhesion promoter for wire. U.S. Pat. No. 9,085,668 discloses impregnating calcium carbonate with a fatty acid to reduce dusting and improve dispersion in a polymer system. There are also numerous patents describing treated silica for use as polymerization catalysts. It is also known to treat relatively large size pigment particles to improve their dispersion or electrostatic charge properties. U.S. Pat. No. 5,401,313 to Supplee discloses techniques to treat iron oxide particles with surface inorganic chemicals and dispersion promoting agents to improve their electrostatic charge and dispersion in such products as concrete or magnetic toners.

While these treated pigments may be suitable for their intended purpose, they would not function as toner charge control agents and they would not satisfy the main advantages provided by the inventive novel composite charge control agents. First, they would not allow for colorless charge agents and color toners. Second, the use of inorganic treatments on existing charge control agents would destroy their function. Third, the inorganic surface treatments would not provide the flexibility to use almost any existing commercial charge control agent. Fourth, the surface treatment of inorganic particles does not provide a means for incorporating additional toner-related components. Finally, they would not provide a means of significantly reducing the quantity and thus cost of using traditional charge control agents. U.S. Pat. No. 8,580,470 to Otsuka discloses mixing charge control agents with a white inorganic filler to influence toner charging. In this case a relatively small amount of the filler is admixed with large amounts of charge control agents. While this may provide some improvement over traditional charge agents it will not provide the flexibility and cost advantages of the inventive process.

SUMMARY OF THE INVENTION

A first aspect of the present invention is directed to creating a process for economically preparing a wide variety of dyed, pigmented, or treated particles that can function as electrostatic charge control agents. A second aspect of the present invention is the production of charge agents with improved dispersion in toner compositions. A third aspect is directed to the preparation of charge agents with reduced hazardous issues such as flammability. A fourth aspect of the invention is directed to providing charge agent particles that will be uniformly distributed and in toner particles. A fifth aspect of the present invention is to provide charge agent particles that also contain some or all of the wax required of a toner and/or an additional component such as security. A sixth aspect of the present invention is the production of charge agent particles that also include an additional visible or invisible component for security control. In each of the above aspects of the present invention, the charge agent used to impregnate the inorganic core will preferably be one known commercially that is non-hazardous.

These features of the present invention are achieved by the use of porous inorganic core particles of approximately the size desired of the final charge control agent. The core particles are impregnated with at least known charge control agent and preferably one or more additional components selected from polymers, wax, pigments, colorants, charge control agents, or specialty chemicals. The process involves adsorption of such ingredients from solvent solutions, emulsions, or dispersions and drying of the powder.

DETAILED DESCRIPTION OF THE INVENTION

The basic concept of the present inventive process is to first obtain an inorganic core particle whose particle size is approximately the same as that desired of the final charge control agent. That core particle is then impregnated with a composition that includes at least one charge control agent and optionally one or more additional materials selected from waxes, polymers, dyes, pigments, or specialty chemicals, depending on the composition desired of the final composite powder.

A first implementation of the inventive process is the production of novel composite charge control agents by impregnating a suitable inorganic core whose particle size is approximately that desired of the final charge control agent. This can involve use of one or more agents selected from organic chemicals, dyes, pigments or commercial charge control chemicals. In each case the particle size of the charge control agent is reduced to a size significantly smaller than the inorganic core particle size, and preferably below 1 micron. If the charge control chemical is in the form of a large particle size powder, its size can be reduced by any common dry or wet milling operation and could include use of a dispersant to maintain the milled particles in a dissociated state. The charge control agent can also be dissolved in a suitable aqueous or organic solvent.

Suitable charge control agents include, but are not limited to, amino acids, basic dyes, quaternary ammonium salts, organo boron complexes, polymeric amines, metal complex dyes, acid dyes, and salicylate metal complexes. A partial list of suitable charge agents is disclosed in U.S. Pat. No. 4,362,803 and an extensive list of commercially available charge control agents is available in the reference work Toner Raw Material Handbook and Information Service published by Toner Research Services.

A suitable porous core particle can be amorphous silica, alumina, titania, metal carbonates or metal silicates. The inventive process may be carried out with a broad range of particle size cores depending on the particle size of the toner or powder that the charge agent will be used in. If the particle size of the core is too small a pigment charge control agent may not be adsorbed on the core but will instead exist as separate particles. It is also not desirable to have the core similar in size to that of the toner, unless the formulated charge control agent can be broken into smaller aggregates during toner melt mixing operations. The optimum size core will vary with a particular toner, the surface area of the inorganic core and the charge level desired. In general, a particle size within the range of 0.08 and 5 microns is preferred for most toners. Air classification of the core particles can be used to produce a desired particle size or size distribution if it is not available commercially.

The surface chemistry and pH of the core can also play a synergistic role in the composite charge agent. For example, inorganic cores with acidic surfaces may contribute to higher negative charging of the composite agents while basic cores may be preferred for positive charge agents. In general, higher surface area cores with larger pores will allow for adsorption of higher quantity and smaller particle size charge agents. Suitable inorganic cores in various particle size ranges are commercially available from such companies as Ineos Silica, Fuji Sylysia, Rhodia, Rhone Poulenc, PPG, J.M. Huber and Degussa. They include silicon, aluminum and titanium oxides as well as metal carbonates and silicates. It is also possible to produce precipitated inorganic oxide particles with specific compositions and particle sizes, with many such processes described in the literature.

One technique for impregnating the inorganic cores is to form an aqueous or solvent based solution or dispersion of the charge control chemicals, spray the dispersion onto a fluidized suspension of the cores, and dry the composite particles by known drying techniques. This is accomplished by using such devices as fluid bed, V-cone blender, etc. A second option is to adsorb the solution or dispersion on a quantity of inorganic core particles and then dry the composite particles. The quantity of inorganic core particles is approximately the amount required to absorb all of the fluid.

While the above process can provide some improvement over traditional charge control agents, it does not provide a completely adequate solution in that the charge agent may be loosely adsorbed on the inorganic core and can become dislodged during imaging processes and lead to image and hardware problems.

A more preferred composite charge control agent consists of impregnating the inorganic core with a composition consisting of one or more charge control chemicals and at least one or more wax or polymer compounds. The primary function of the wax or polymer is to act as a binder for the charge control chemical. In general, any wax or polymer that is solid at room temperature and can be formed into a solution, dispersion or emulsion can be suitable for this implementation. However, to achieve the maximum benefit from the inventive process it is preferred to choose a wax or polymer binder that offers some synergetic benefit to the toner charging or other toner property. For example acidic groups on the wax or polymer can increase negative charging while basic groups can contribute to higher positive charging.

The quantity of polymer or wax binder used will depend on its desired functions. If the function is simply to bind the charge control agent to the core, a minimal amount of wax or polymer may be desired. However, it is possible to use this process as a convenient method of incorporating some or all of the wax commonly used as an internal toner lubricant. The majority of current toners contain from 3% to as much as 10% or more internal wax lubricants that act as release agents for hot roll fusing systems. As the toned image contacts heated fuser rolls the wax melts and coats the rolls. However these lubricants are not usually compatible with toner polymers and they reduce shear in melt extrusion, thus making toner preparation difficult. An additional problem of toners containing melt mixed wax lubricants is that the incompatible wax may separate from the toner during milling operations. The wax particles form satellites that can adhere to toner surfaces. During the electrophotographic process these wax particles may separate from the toner and adhere to such machine components as charge rolls or photoreceptors, with resulting degradation of print image quality. Polymer/wax compatibilizers are sometimes included in a toner composition to minimize this problem but this does not provide a completely satisfactory solution. Use of wax-coated inorganic cores can be an effective method of providing uniformly distributed wax within a toner as the particles disperse much easier. Wax coated inorganic cores can also allow the use of significantly lower concentrations of wax.

A number of techniques can be used to impregnate the inorganic cores with the above composition. First, the charge control agent can be dispersed in an aqueous or solvent system where the wax or polymer is dissolved, dispersed or emulsified. That composition can either be sprayed on the inorganic cores or adsorbed as already described. A second technique for forming the composite particles is to use a solvent precipitation process as described in U.S. Pat. No. 3,971,749 to Blunt. A wide variety of wax, olefin and hydrocarbon polymers can be dissolved in such heated hydrocarbon fluids as odorless mineral spirits, Magie oils, paraffin oils or other hydrocarbon fluids and when cooled the wax or polymer precipitates. Some examples of polymers suitable for this purpose are most waxes, polyethylenes, propylene, high ethylene content ethylene-vinyl acetate polymers, and hydrocarbons such as Picco 5120 (Hercules). For this implementation the preferred hydrocarbon fluid is one that is environmentally friendly, will dissolve the wax or polymer, and can easily be evaporated. The quantity of fluid used is approximately the amount required to completely wet the inorganic core. An excess of fluid could technically be used although that requires more time and effort for its evaporation. A third technique for forming the composite particles is to form an aqueous or organic solvent solution of charge control agent and polymers and either spray or adsorb the solution on the inorganic cores as already described. For this implementation a wide range of fluids are possible, including hydrocarbons, acetone, toluene, and environmentally friendly bio derived fluids. For this implementation a relatively small amount of charge dye can be used as the polymer/dye mixture is predominantly adsorbed on the surface of the inorganic core. This implementation is especially useful for preparing colored charge control agents or ones that may use solvent soluble organic chemicals such as quaternary ammonium compounds.

The techniques described for forming composite charge control agents can also be used to produce more complex charge control agents. Thus, additional modifying agents may be included during any one of the above processes. For example, conductivity modifying agents, colored dyes, IR or UV-absorbing dyes or pigments can be included in the compositions to either adjust electrostatic properties or provide an additional security or identification feature.

Any of the above charge control agents can be used in the same manner as traditional charge control agents. For melt mixed toners the amount of inventive charge control agent may range from 0.5 to 4% or more, depending on the charge rate, charge magnitude and charge distribution desired. The inventive composite charge control agents can be designed to have the same charge characteristics as traditional charge agents such that they are used at the same concentration. Optionally, the charge agents can be designed with lower charge magnitude such that higher concentrations are used. This can be an effective technique for achieving more uniform toner charging or incorporation of higher wax concentrations. Because the composite charge agents are less expensive to produce the higher concentration would not add to toner cost.

The inventive charge control agents are not limited to use only in conventional dry toners. A variety of non-traditional processes are currently being used to produce toners. These include such techniques as suspension polymerization, aggregated emulsion, solvent milling, evaporative coalescence and others. Each of these toners must also achieve certain levels of charge magnitude, charge rate, and charge stability. Inclusion of traditional charge control agents in most of these processes has either been difficult at best so that the toner producer frequently relies on external additives to control toner charge. While this may provide an adequate technical solution for these so-called chemical toners, relatively large amounts of expensive additives are required. These additives can present difficulties in EP hardware as they frequently separate from the toner and collect on drums, charge rolls, developer rolls or cleaning blades. In addition, these ultra fine additives can become airborne during use and present possible environmental issues. The inventive composite charge control agents can be easily used in many of these processes because of the ability to control their particle size and charge properties. It is also easy to design either positive or negative charge agents as well as a broader array of colorless charge agents.

The inventive charge control agents are suitable for applications in addition to toners. Electrostatic powder coating also relies on charged powders. Until recently this industry did not adequately concern itself with carefully controlling the powder charging, resulting in inefficient and wasteful spraying. The inventive composite charge agents can be especially beneficial for this process as versions can be produced at low cost and with great versatility.

As can be readily seen from the previous discussion, the inventive process provides numerous benefits for the production of a wide variety of electrostatic charge control agents.

First, it is very versatile as almost any dye, pigment or organic chemical capable of altering toner charge could be coated or impregnated in the core. For example, a wide variety of colored charge agents are possible. Also, both positive and negative charge control agents can be produced. The technique also provides a simple way to produce complex charge agents in that mixtures of charge chemicals and optionally conductive or modifying components can be included in the particle. The technique provides a simple method of producing charge agents with almost any desired size. The technique also provides a method of lowering the cost of charge control agents, one of the most expensive components of a toner. This benefit is based on the fact that a small amount of active charge agent chemical is contained primarily on the inorganic core, which typically has very high surface area. For example, it is possible to impregnate the inorganic core with as little as 5% of an expensive, commercially available charge agent and achieve a desired electrostatic charge. Another unforeseen benefit for the composite charge agent was the use of wax as the charge agent binding component. By proper selection of the wax, improved toner fixing and anti-offset can be achieved when compared to toners without the wax. By judicial selection of the type and quantity of wax used for these novel composite charge agents it may be possible to reduce or eliminate use of additional wax in the toner. This would provide a significant benefit in terms of toner preparation, but an even greater benefit in that it could reduce the amount of free wax particles that tend to accumulate on charge rolls and photoreceptors. This unexpected benefit is possible because the small particle size and high surface area of the inorganic cores provides a large amount of effective surface area to be coated with wax. The composite charge control agents have also been found to disperse much easier during melt mixing as compared to conventional charge agents and this can improve toner processing rates. The composite charge agents can also be safer to use. Certain charge control dyes are potentially flammable but this would be reduced when adsorbed on an inorganic core.

The following examples are provided as representative techniques for forming composite charge control agents according to the present invention. They are illustrative but are not meant to define limitations of the process.

Example 1

60 g of Bontron E-84 (Orient Chemical) was dissolved in 300 ml MEK. This was added to 400 g Multifex MM (Specialty Minerals) precipitated calcium carbonate in a 600 ml beaker. The mixture was agitated in an ultrasonic bath for two minutes and placed in an oven to dry. A toner was prepared by extruding a mixture of 2% of the charge agent complex, 4% polypropylene wax, 40% magnetic iron oxide and 64% styrene acrylic resin. The extruded mixture was jet milled, classified and blended with 0.5% hydrophobic silica. It was placed in an HP 4250 laser printer and over 1000 prints were produced with quality equal or superior to OEM prints and with no deterioration in quality over that run length.

Example 2

50 g of positive charge agent P12 was dissolved in 400 ml of methanol and this was added to 450 g of Multifex MM precipitated calcium carbonate, mixed for 5 minutes in a vessel with dish-shaped heads and an anchor/paddle agitator and then dried. The product was used as a positive charge agent to produce a commercially viable Kyocera toner.

Example 3

5 g of Otsuka BS-1 resin (48.7% concentration) was dissolved in 200 ml of methanol. 25 g of positive charge agent P12 was next dissolved in the above solution. This solution was then added to 222.5 g of Multifex MM precipitated calcium carbonate and mixed 5 minutes. It was dried and used to produce a positive charge toner.

Example 4

0.5 g of Bayer Macrolex Red H dye and 4.5 g Baker Petrolite Unicid 425 were dissolved in 25 g heated odorless mineral spirits. This was added to 14 g Fuji Sylysia grade 460 silica that had been air classified to collect under 5 micron particles. The dispersion was cooled to precipitate the wax and dried to form red composite particles that could be used as charge control agents Example 5

A dispersion was prepared by media milling 30 g T-77 charge agent (Hodogaya Chemical) and 110 g odorless mineral spirits. After milling 1 hour, the dispersion was separated and washed with additional OMS and 210 g dispersion collected. 140 g of the dispersion and 20 g Unicid 425 polymer were heated to 110° C. 20 g HP 270 silica was added to the heated dispersion and the mixture cooled and dried. 30 g of the final product was formulated into a toner comprised of crosslinked polyester resin, 40% iron oxide, and 4% polyolefin wax. The toner was jet milled, classified and the triboelectric charge measured using a ferrite carrier and Vertex blow-off device. The charge at 10 seconds was −16.0 and −21.5 at 20 minutes. A control toner using 1.5% T-77 charge agent had triboelectric charge of −19 at 10 seconds and −17.6 at 20 minutes.

Example 6

30 g of an iron based commercial charge control agent was media milled with 110 g odorless mineral spirits. The milled pigment was screen separated and washed with OMS.

163 g was collected. This was separated into two fractions. 82 g of the dispersion was placed in a 400 ml beaker, along with 18 g additional OMS and 10 g Ineos HP270 silica. The mixture was heated to approximately 100° C. and cooled with moderate stirring. The modified charge control agent was dried and processed into a toner comprised of styrene-acrylic resin, 4% polyolefin wax, 40% magnetic oxide and the above charge control agent. Triboelectric charge measurements were made using a commercial device supplied by Vertex, a standard ferrite carrier and mixing for 10 seconds, 2 minutes, 5 minutes and 20 minutes. The charge at 10 seconds was −14.6 and −21.4 at 20 minutes. A control toner using 1.5% of the same iron based charge agent gave charge measurements of −14.7 at 10 seconds and −8.6 at 20 minutes. Print tests using a Hewlett Packard laser printer showed improved quality when compared with the control toner.

Example 7

The second portion of pigment dispersion (82 g) from experiment 6 was combined with 18 g OMS, 10 g Ineos HP270 silica and 15 g Unicid 425 polymer (Baker Petrolite). The modified charge agent was processed as in Example 13 and used to produce a toner with the same composition as Example 13. Triboelectric charge was −25.7 at 10 seconds and −33.2 at 20 minutes. This experiment demonstrated improved charge when an acid functional wax was included in the composite charge agent composition. Print tests using a Hewlett Packard laser printer showed improved quality when compared with the control toner.

Example 8

A pigment dispersion was prepared by media milling 7.5 g Ticona Topas polymer, 65 g OMS and 16 g commercial iron base charge agent. The dispersion was separated, combined with 20 g Ineos HP 270 silica and dried. The modified charge agent was used to produce a toner as in Example 13. Triboelectric charge ranged from −17.4 at 10 seconds to −18.9 at 20 minutes Example 9

A composition of 16 g Hodogaya TRH charge control agent and 130 g distilled water were media milled for 2 hours, screen separated, and washed, providing 300 g of dispersion. 32 g of Michem Lube 156 (Michelman) was then stirred into the above dispersion. 40 g of Ineos HP 260 silica was slowly added to the resulting dispersion, providing a very slight excess of liquid. The composite charge agent particles were dried and 2% incorporated in a toner composition as in Example 13. The resulting toner was tested in a Hewlett Packard printer and exhibited print quality superior to a comparative toner that had been prepared with 2% of standard TRH charge control agent.

The inventor does not want to be limited to the technique of impregnating the porous particles, the type of porous particles or the size of the porous particles. Also, instead of the charge control agent above many other dyes, pigments, chemicals, or biological components could be impregnated in the porous inorganic core to provide composite particles.

What is claimed is:

1. A process for producing a composite charge control agent wherein a porous inorganic core particle of at least approximately 0.08 microns in diameter is impregnated with 2% to 50% by weight of one or more charge control chemicals and up to 50% by weight of one or more additional compounds selected from the group consisting of: a polymer, a wax, a dye, and combinations thereof.

2. A process according to claim 1 wherein the inorganic core particle is chosen from the group consisting of: amorphous silica, alumina, titania and calcium carbonate.

3. A process according to claim 1 wherein the inorganic core particle is treated with a chemical to adjust its pH and/or hydrophobicity either before or after the coating or impregnation operation.

4. A process according to claim 1 wherein an aqueous or organic solution or dispersion is formed from a solvent, at least one charge control chemical and one or more additional components selected from the group consisting of: a polymer, a wax, a dye, and combinations thereof and the solution or dispersion is sprayed onto the inorganic core particles, and optionally, the composite particles are dried.

5. A process according to claim 1 comprising the steps of:

forming an aqueous or organic solution or dispersion from at least one charge control chemical and one or more additional components selected from the group consisting of: a polymer, a wax, a dye, and combinations thereof;

adding the solution or dispersion to a quantity of inorganic core particles which adsorb the solution or dispersion so as to form composite particles; and optionally, drying the composite particles.

6. A process according to claim 1 comprising the steps of:

forming a dispersion of a mixture of at least one charge control chemical and one or more additional component selected from the group consisting of: a polymer, a wax, a dye, and combinations thereof in a liquid that does not dissolve some or all of the wax or polymer at room temperature;

heating said dispersion to a temperature such that the polymer or wax dissolves;

adding the heated dispersion to a quantity of inorganic core particles which function to absorb the heated dispersion so as to form a composition thereof;

cooling the composition so as to precipitate the wax and/or polymer; and optionally, evaporating residual liquid from the composition.

7. A composite charge control agent comprising: porous inorganic core particles of at least 0.08 microns in diameter impregnated with 2% to 50% by weight of one or more charge control chemicals and up to 50% by weight of one or more additional compounds selected from the group consisting of: a polymer, a wax, a dye, and combinations thereof.

8. The composite charge control agent of claim 7, wherein said inorganic core particles are chosen from the group consisting of metal oxides, metal carbonates, and combinations thereof.

9. The composite charge control agent of claim 7, comprising: 50 to 95% of said inorganic core particles.

10. The composite charge control agent of claim 7, wherein said wax is an acid or amine functional wax.

11. The composite charge control agent of claim 7, wherein said polymer is at least one acid or amine functional polymer.

12. The composite charge control agent of claim 7, wherein the agent also includes an additional IR or UV visible dye or pigment.

13. A process according to claim 1, wherein the porous inorganic core particle is impregnated throughout with 2% to 50% by weight of one or more charge control chemicals and up to 50% by weight of one or more additional compounds selected from the group consisting of: a polymer, a wax, a dye, and combinations thereof.

14. A process according to claim 1, wherein the diameter of the porous inorganic core particle is from 0.08 microns to 5 microns.

* * * * *